US007228677B2

(12) United States Patent
Yu Chen

(10) Patent No.: US 7,228,677 B2
(45) Date of Patent: Jun. 12, 2007

(54) MEMBRANE RELEASING-TIGHTNESS ADJUSTING DEVICE FOR A MEMBRANE STRAPPING DISPENSER

(76) Inventor: Hsiu-Man Yu Chen, No.27, Sec. 1, Dafu Rd., Tanzih Township, Taichung County 427 (TW)

( * ) Notice: Subject to any disclaimer, the term of this patent is extended or adjusted under 35 U.S.C. 154(b) by 30 days.

(21) Appl. No.: 11/263,899

(22) Filed: Nov. 2, 2005

(65) Prior Publication Data

US 2007/0095025 A1 May 3, 2007

(51) Int. Cl.
*B65B 67/00* (2006.01)
*B65B 67/08* (2006.01)

(52) U.S. Cl. ..... 53/592; 53/582; 53/390; 242/570; 242/579; 242/586.2

(58) Field of Classification Search ..... 53/582, 53/592, 390; 242/588, 588.2, 570, 579, 586, 242/586.2; 156/577
See application file for complete search history.

(56) References Cited

U.S. PATENT DOCUMENTS 4,102,513 A * 7/1978 Guard ..... 242/423.1
4,166,589 A * 9/1979 Hoover et al. ..... 242/423.1
4,375,278 A * 3/1983 Beeck ..... 242/571.3
4,522,348 A * 6/1985 Strout et al. ..... 242/422.1
4,535,951 A * 8/1985 Riemenschneider, III ..... 242/423.2
4,714,211 A * 12/1987 Hwang ..... 242/423.1
4,752,045 A * 6/1988 Goldstein ..... 242/588.2
5,779,179 A * 7/1998 Zentmyer et al. ..... 242/423.2
6,598,378 B1 * 7/2003 Pottier ..... 53/556
6,739,542 B1 * 5/2004 Prina et al. ..... 242/423.2
6,883,298 B2 * 4/2005 Gooding et al. ..... 53/592
6,920,742 B1 * 7/2005 Yu Chen ..... 53/592
6,926,225 B1 * 8/2005 Powers ..... 242/588.2

* cited by examiner

*Primary Examiner*—Scott A. Smith
*Assistant Examiner*—Gloria R. Weeks
(74) *Attorney, Agent, or Firm*—Troxell Law Office, PLLC

(57) ABSTRACT

A membrane releasing-tightness adjusting device for a membrane strapping dispenser is installed at one side of a basic body of a membrane strapping dispenser and provided with a threaded rod having a support shaft and a tightening member pivotally assembled thereon and having a rubber ring fitted on the support shaft. When compressed by both the support shaft and the tightening member, the rubber ring with great elasticity will be deformed outward to fix the membrane reel of the membrane strapping dispenser in position, able to control membrane releasing tightness and enhance effect in membrane strapping work.

4 Claims, 6 Drawing Sheets

MEMBRANE RELEASING-TIGHTNESS ADJUSTING DEVICE FOR A MEMBRANE STRAPPING DISPENSER

BACKGROUND OF THE INVENTION

1. Field of the Invention

This invention relates to a membrane releasing-tightness adjusting device for a membrane strapping dispenser, particularly to one pivotally assembled at one side of the main body of a membrane strapping dispenser and able to fix a membrane reel in position from the interior of the membrane reel for controlling the membrane reel to release membrane with proper tightness.

2. Description of the Prior Art

A membrane-strapping dispenser is employed for carrying out membrane strapping on goods when they are to be transported. A conventional membrane strapping dispenser, as shown in FIG. 1, includes a basic body 1 having its opposite sides respectively and pivotally provided with a holding base 2 aligned to each other. A membrane reel 3 is pivotally assembled between the two holding bases 2 to be actuated to rotate and release the membrane for strapping.

During strapping of goods, membrane must be closely wrapped around goods for protection. However, the two holding bases 2 provided at the opposite sides of the conventional membrane strapping dispenser can only function to position the membrane reel 3 therebetween and permit it to rotate thereon but cannot control its membrane releasing tightness. Therefore, during carrying out membrane strapping, adjustment of membrane strapping tightness has to be done with the help of a user's hands, thus complicating strapping work.

SUMMARY OF THE INVENTION

The objective of the invention is to offer a membrane releasing-tightness adjusting device for a membrane strapping dispenser, which is installed at one side of the basic body of a membrane strapping dispenser and provided with a threaded rod having a support shaft and a tightening member pivotally assembled thereon and also having a rubber ring fitted on the support shaft. When compressed by both the support shaft and the tightening member, the rubber ring with great elasticity will be deformed outward to push against and firmly fix the membrane reel that is pivotally assembled on the membrane strapping dispenser, able to control the membrane reel to release membrane with proper tightness and elevate effect in membrane strapping work.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
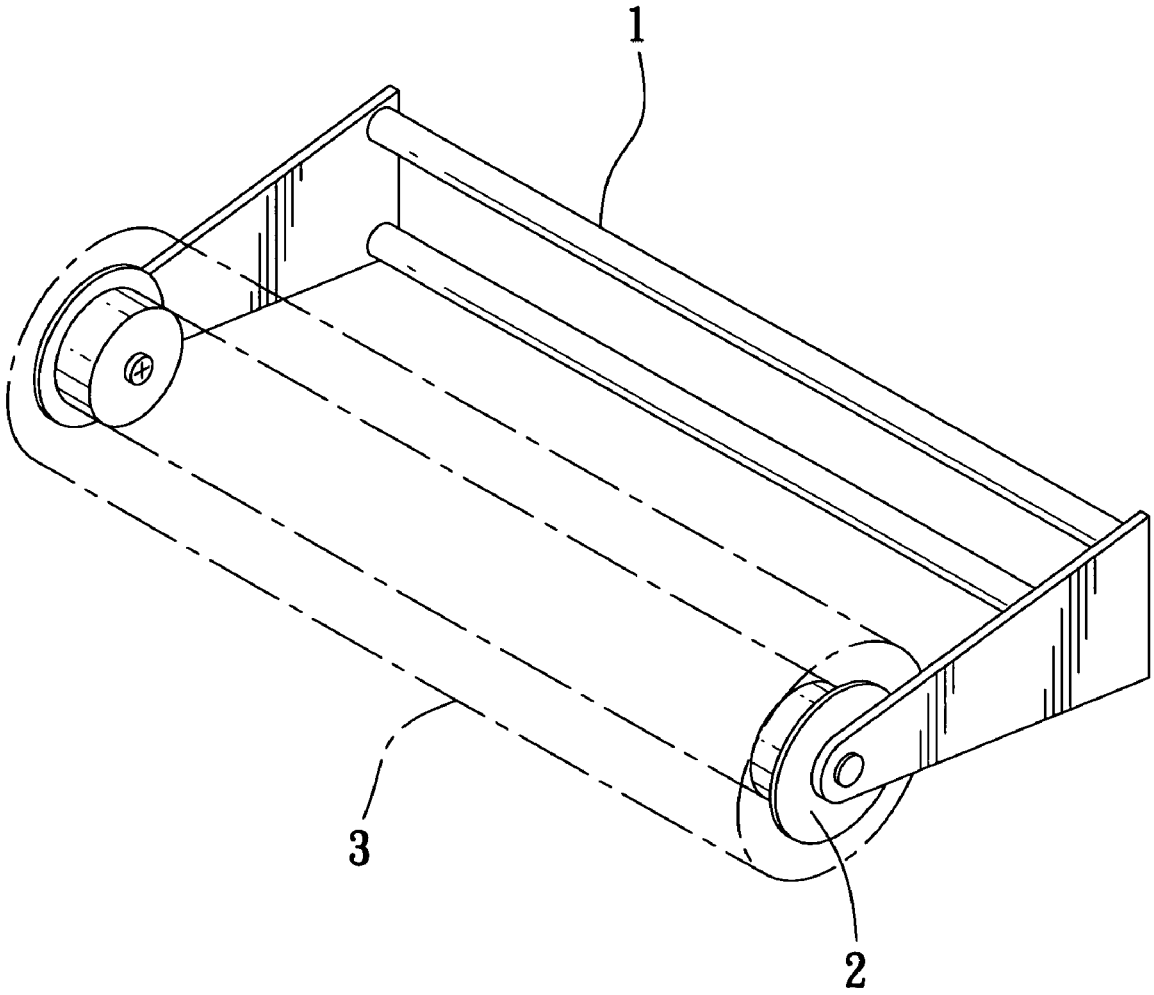
FIG. 1 PRIOR ART
FIG. 1 is a perspective view of a conventional membrane-strapping dispenser.
Figure 2:
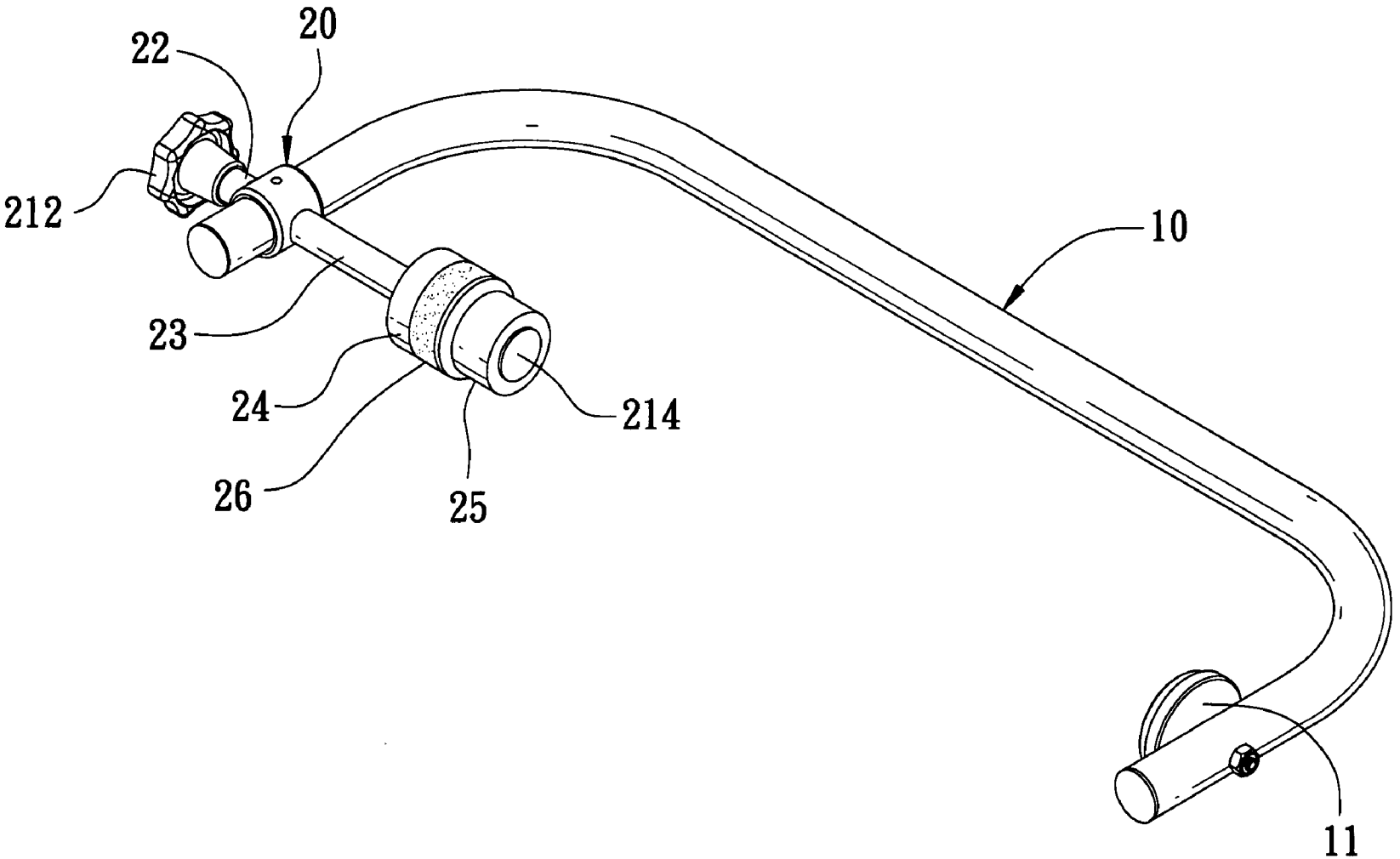
FIG. 2 is a perspective view of a membrane releasing-tightness adjusting device in the present invention.
Figure 3:
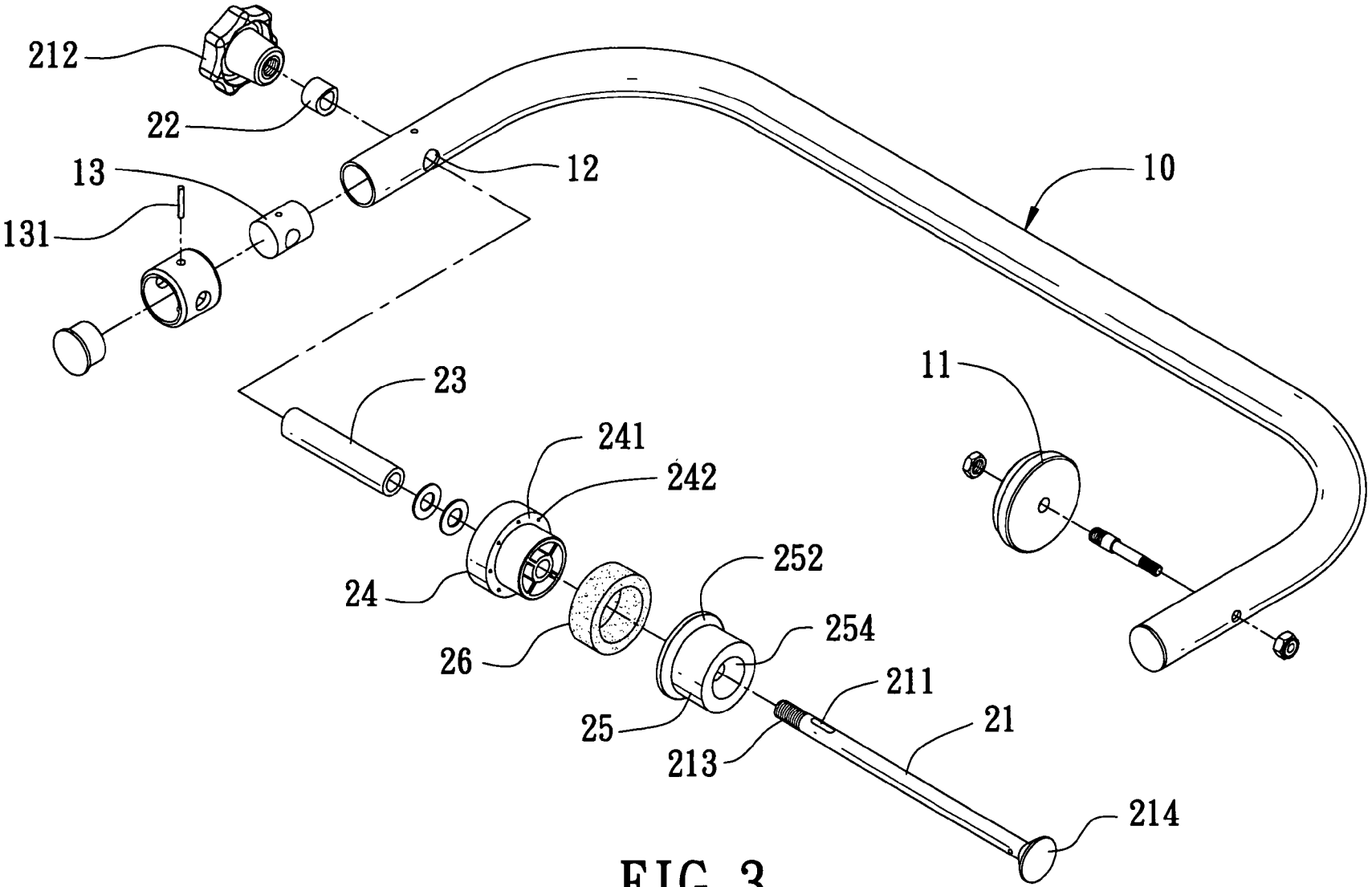
FIG. 3 is an exploded perspective view of the membrane releasing-tightness adjusting device in the present invention.
Figure 4:
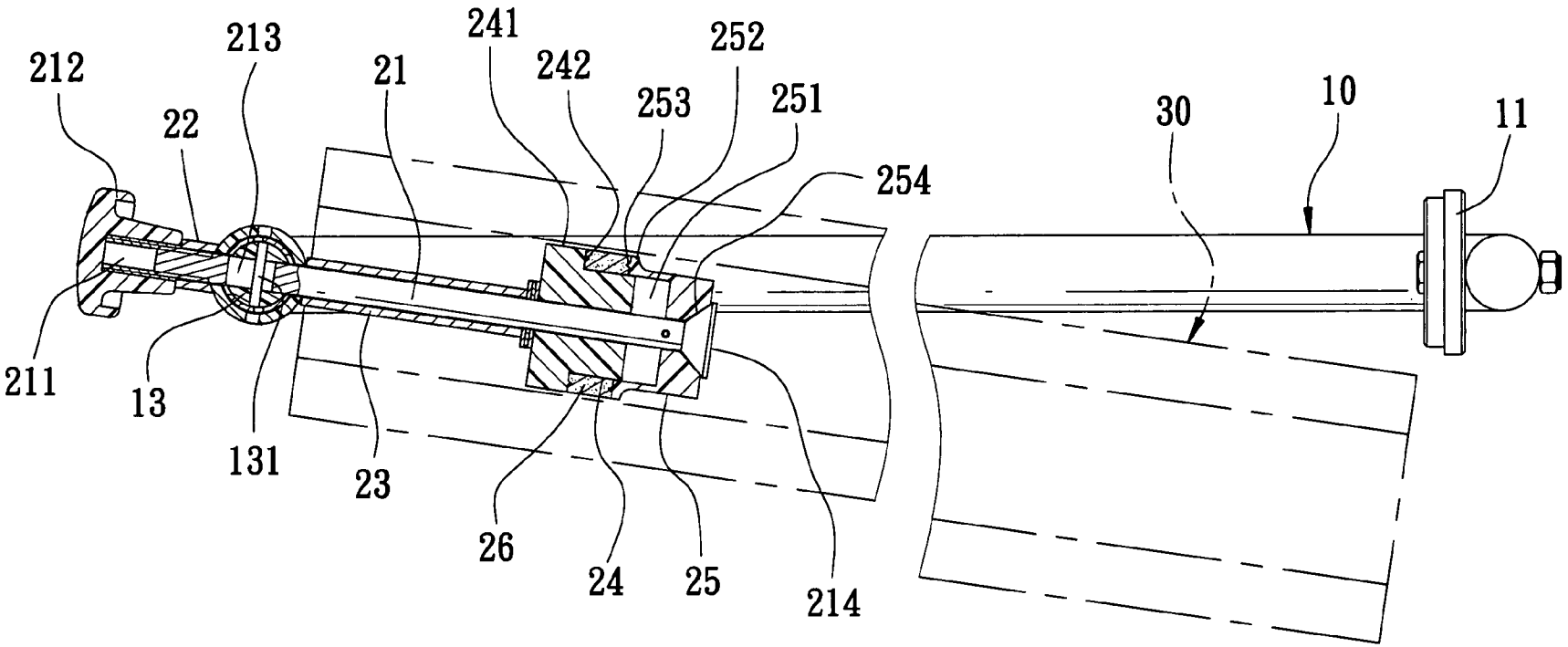
FIG. 4 is a side cross-sectional view of the membrane releasing-tightness adjusting device assembled thereon with a membrane reel in the present invention.
Figure 5:
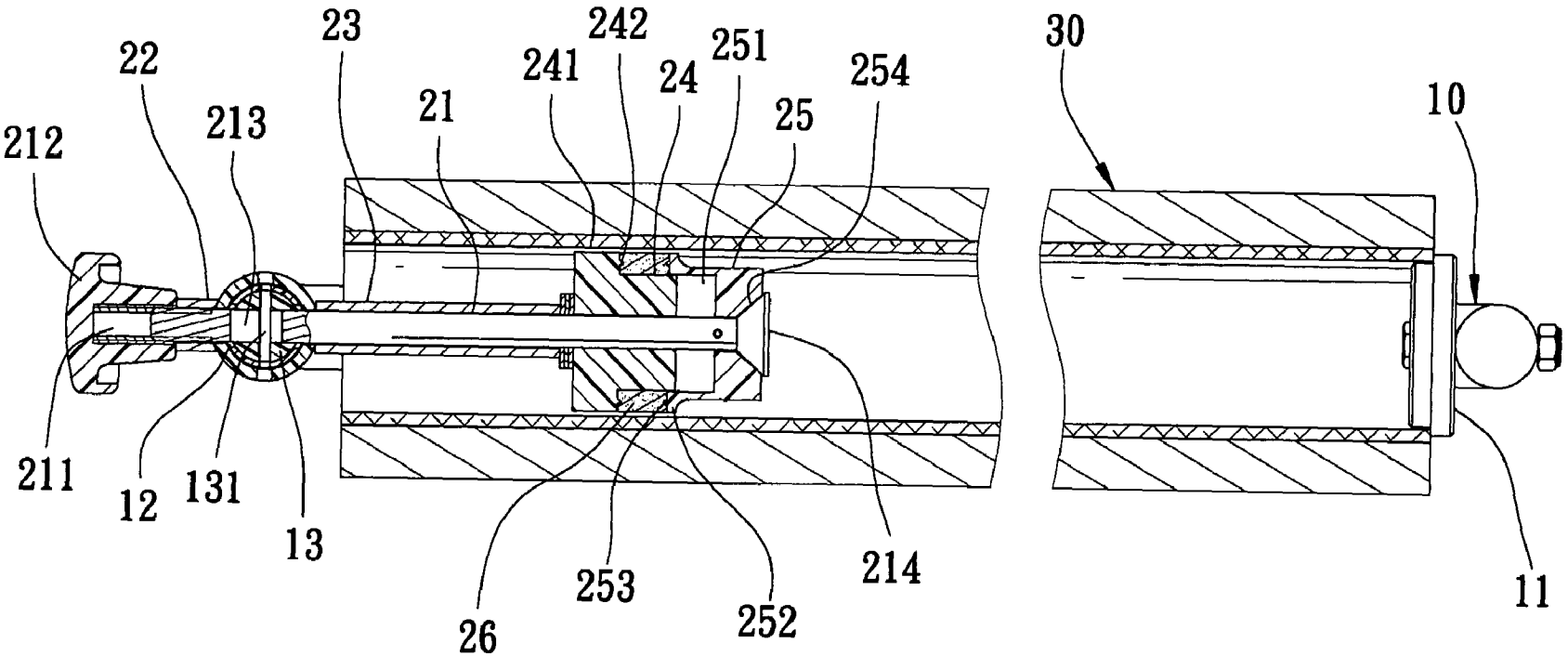
FIG. 5 is a side cross-sectional view of the membrane releasing-tightness adjusting device not yet being tightened in the present invention.
Figure 6:
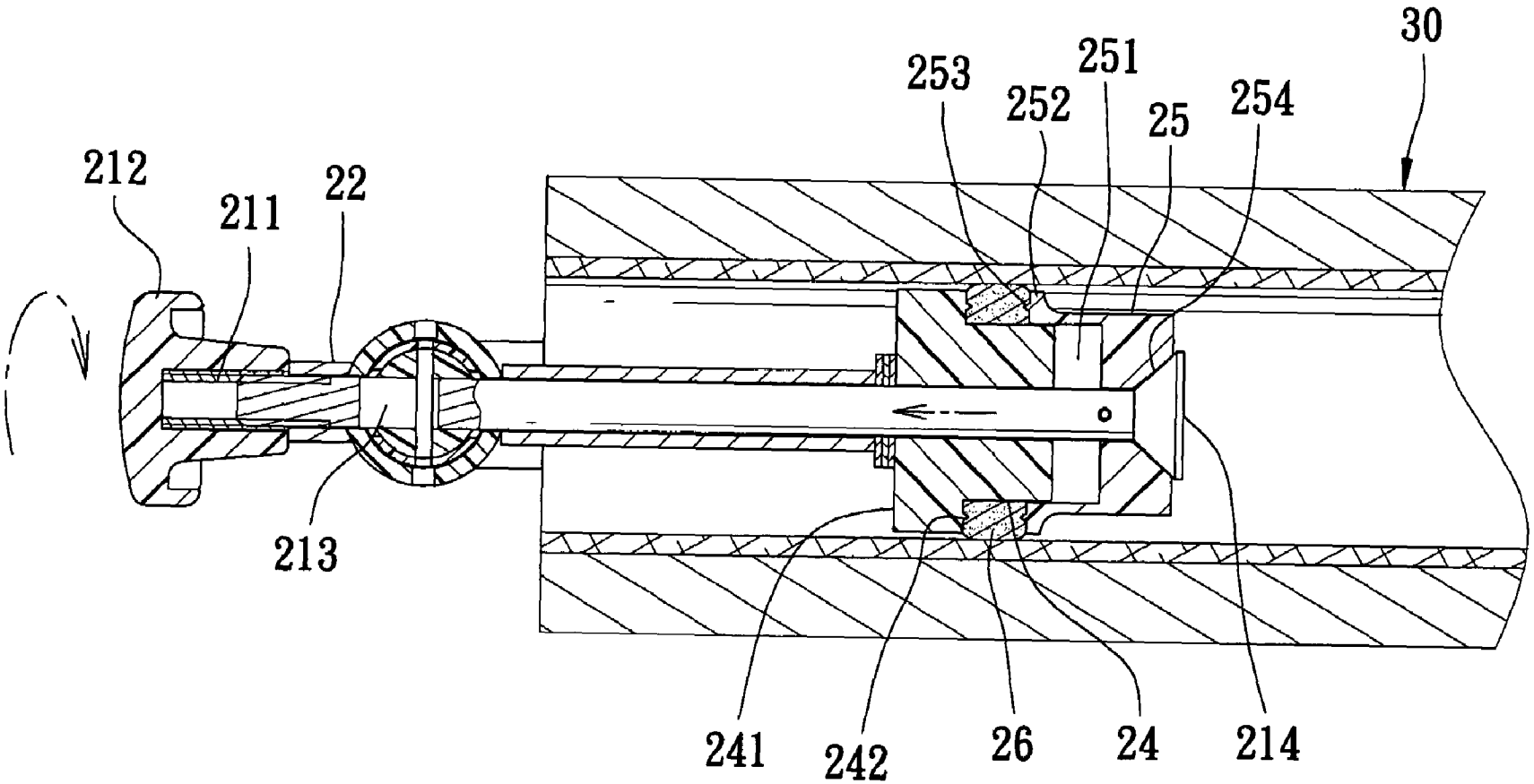
FIG. 6 is a partial side cross-sectional view of the membrane releasing-tightness adjusting device in a tightened condition in the present invention.

A membrane releasing-tightness adjusting device for a membrane-strapping dispenser in the present invention, as shown in FIGS. 2 and 3, includes a basic body 10 and a tightness-adjusting device 20.

The basic body 10 is a hollow U-shaped round tube having one end pivotally provided with a stepped disc holding base 11 and the other end bored with a round hole 12. The basic body 10 has the interior corresponding to the round hole 12 inserted therein with a position-limiting block 13.

The tightness-adjusting device 20 to be fitted with the round hole 12 of the basic body 10 consists of a threaded rod 21, an upper position-limiting tube 22, a lower position-limiting tube 23, a support shaft 24, a tightening member 25 and a rubber ring 26.

The threaded rod 21 has its upper end inserted through the round hole 12 of the basic body 10, with a preset gap formed between the threaded rod 21 and the round hole 12 to enable the threaded rod 21 to slightly shift bias in the round hole 12. The threaded rod 21 has its upper end formed with male threads 213 assembled with a rotary handle 212. Further, the threaded rod 21 is lengthwise bored with an elongate slot 211 in a preset location. A positioning pin 131 is inserted through the position-limiting block 13 and positioned in the elongate slot 211 for restricting the threaded rod 21 in position and enabling the threaded rod 21 to move upward and downward. Furthermore, the threaded rod 21 has its lower end secured with a conical press member 214.

The upper position-limiting tube 22 is fitted on the threaded rod 21 and positioned at the outer side of the basic body 10, having its upper end assembled with the rotary handle 212.

The lower position-limiting tube 23 is fitted on the threaded rod 21 and positioned at the inner side of the basic body 10, having its lower end connected with the support shaft 24.

The support shaft 24 has its outer side fitted with the rubber ring 26, and its upper side extending outward and forming a press block 241 having its inner annular surface fixedly provided with plural pointed projections 242 of a preset number to be pressed on the rubber ring 26.

The tightening member 25 has its upper end bored with an accommodating recess 251 for receiving the support shaft 24 therein. The accommodating recess 251 has its upper annular edge extending outward and forming an annular press surface 252 having pointed projections 253 preset in number secured thereon for pressing the rubber ring 26. Further, the tightening member 25 has its lower inner side bored with a conical groove 254 for receiving the conical press member 214 of the threaded rod 21.

The rubber ring 26 with great elasticity is fitted on the support shaft 24 to be compressed by both the press block 241 of the support shaft 24 and the annular press surface 252 of the tightening member 25 and deformed outward.

In assembling and using, as shown in FIGS. 2, 4, 5 and 6, the rotary handle 212 assembled on the upper end of the threaded rod 21 is first loosened to enable the threaded rod 21 to be slightly moved bias in the round hole 12 of the basic body 10 and positioned obliquely for an angle. After a membrane reel 30 is fitted on the obliquely positioned threaded rod 21, the threaded rod 21 is moved to recover its original position, and the membrane reel 30 is firmly fixed in position between the tightness adjusting device 20 and the holding base 11 on the basic body 10. Subsequently, the rotary handle 212 on the threaded rod 21 is screwed tight to secure the threaded rod 21 on the basic body 10. At this time, the membrane on the membrane reel 30 can be released for strapping.

To tighten the membrane reel 30, the rotary handle 212 is tightly screwed with the male threads 213 of the threaded rod 21 to let the conical press member 214 at the bottom of the threaded rod 21 moved upward to tightly push against the tightening member 25 and the support shaft 24. Simultaneously, the support shaft 24 is gradually inserted in the accommodating recess 251 of the tightening member 25, and the rubber ring 26 fitted on the support shaft 24 is compressed by both the press block 241 of the support shaft 24 and the annular press surface 252 of tightening member 25 and deformed outward to fix the membrane reel 30 in position and stop the membrane thereon from rolling freely, thus able to control the strapping tightness of the membrane.

As can be understood from the above description, this invention has the following advantages.

1. The membrane tightness-adjusting device is provided with the rubber ring fitted on the support shaft. When compressed by both the support shaft and the tightening member, the rubber ring will be deformed outward to fix the membrane reel in position, able to control membrane releasing tightness of the membrane reel and simplify strapping work.

2. The gap formed between the round hole of the basic body and the threaded rod enables the threaded rod to be slightly moved bias for facilitating the membrane reel to be fitted on the threaded rod and assembled with the membrane strapping dispenser.

While the preferred embodiment of the invention has been described above, it will be recognized and understood that various modifications may be made therein and the appended claims are intended to cover all such modifications that may fall within the spirit and scope of the invention.

I claim:

1. A membrane releasing-tightness adjusting device for a membrane-strapping dispenser comprising:

an U-shaped, hollow tube defining a basic body, said basic body having a first end rotatably assembled with a stepped disc holding base, said basic body having a second end end bored with a round hole opposite to said holding base, a position-limiting block inserted within the basic body and aligned with the round hole; and a tightness adjusting device composed of a threaded rod, an upper position-limiting tube, a lower position-limiting tube, a support shaft, a tightening member and a rubber ring;

said threaded rod fitted with said round hole of said basic body, said threaded rod bored with an elongate slot in a preset location, a positioning pin inserted through said position-limiting block inside said basic body and positioned in said elongate slot of said threaded rod, said threaded rod having its upper end formed with male threads assembled with a rotary handle, said threaded rod having its lower end fixedly provided with a conical press member;

said upper position-limiting tube fitted on said threaded rod and positioned at an outer side of said basic body;

said lower position-limiting tube fitted on said threaded rod and positioned at an inner side of said basic body;

said support shaft rotatably connected with the lower end of said lower position-limiting tube, said support shaft having its upper side extending axially and forming an annular press block;

said tightening member rotatably fitted on the lower end of said threaded rod, said tightening member having its lower end bored with a conical recess matching with said conical press member of said threaded rod, said tightening member having its upper side bored with an accommodating recess with an annular press surface, the inner diameter of said accommodating recess of said tightening member equal to the outer diameter of said support shaft;

said rubber ring fitted on said support shaft, said rubber ring restricted in position by both said annular press surface of said tightening member and said annular press block of said support shaft, said rubber ring having great elasticity and able to be deformed outward after being compressed.

2. The membrane releasing-tightness adjusting device for a membrane strapping dispenser as claimed in claim 1, wherein a preset gap is formed between said round hole of said basic body and said threaded rod.

3. The membrane releasing-tightness adjusting device for a membrane strapping dispenser as claimed in claim 1, wherein said annular press block of said support shaft has an inner surface fixed with a preset number of projections.

4. The membrane releasing-tightness adjusting device for a membrane strapping dispenser as claimed in claim 1, wherein said annular press surface of said tightening member is fixed thereon with a preset number of projections.

* * * * *